United States Patent [19]

Ide et al.

[11] Patent Number: 4,839,564

[45] Date of Patent: Jun. 13, 1989

[54] LARGE IMAGE DISPLAY APPARATUS

[75] Inventors: Katsuyuki Ide, Yokohama; Hisao Kobayashi, Kanagawa; Nanjou Aoike, Yokohama, all of Japan

[73] Assignee: Toshiba Electric Equipment Corporation, Tokyo, Japan

[21] Appl. No.: 207,932

[22] Filed: Jun. 17, 1988

Related U.S. Application Data

[63] Continuation of Ser. No. 749,435, Jun. 27, 1985, abandoned.

[30] Foreign Application Priority Data

Jun. 30, 1984 [JP] Japan ..... 59-136357

[51] Int. Cl.[4] ..... G09G 3/10

[52] U.S. Cl. ..... 315/169.4; 315/169.2; 315/169.3; 315/291; 315/DIG. 4; 315/209 R; 315/169.1; 340/813; 340/767; 340/811; 340/793

[58] Field of Search ..... 315/169.2, 169.1, 169.3, 315/169.4, DIG. 4, DIG. 5, 219, 209; 313/558, 493, 607; 340/811, 793, 805, 767, 771

[56] References Cited

U.S. PATENT DOCUMENTS

| | | | |
|---|---|---|---|
| 4,241,294 | 12/1980 | Fisler | 315/291 |
| 4,488,089 | 12/1984 | Shota | 315/106 |
| 4,495,445 | 1/1985 | Turney | 315/169.4 |
| 4,633,141 | 12/1986 | Weber | 315/307 |
| 4,635,052 | 1/1987 | Aoike et al. | 340/811 |
| 4,645,979 | 2/1987 | Chow | 315/169.1 |

FOREIGN PATENT DOCUMENTS 59-19995 2/1984 Japan .

*Primary Examiner*—David K. Moore
*Assistant Examiner*—Michael Razavi
*Attorney, Agent, or Firm*—Oblon, Fisher, Spivak, McClelland & Maier

[57] ABSTRACT

A large image display apparatus comprises a plurality of discharge lamps each having an anode, a cathode and a light emitting tube, a display board having the plurality of discharge lamps thereon, a heating circuit for heating the cathodes of the plurality of discharge lamps, a power supply circuit for generating a rectified high frequency voltage and biasing the plurality of discharge lamps, an image signal generator for generating an image signal, and a control circuit for controlling the quantity of light emitted from each discharge lamp in response to the image signal.

13 Claims, 7 Drawing Sheets

LARGE IMAGE DISPLAY APPARATUS

This application is a continuation of application Ser. No. 06/749,435, filed on June 27, 1985, now abandoned.

BACKGROUND OF THE INVENTION

This invention relates to a large image display apparatus in which such images as television video signals or image signals are displayed on a display board including a large number of display elements.

In a conventional display apparatus of this type, a large number of incandescent lamps, cathode ray tubes or discharge lamps are used as the display elements. However, such prior art display apparatus using the incandescent lamps is not satisfactory in that the operating life of the incandescent lamps is relatively short, the lamps consume a large amount of power and generate a large quantity of heat, thus requiring a large and expensive cooling means. Furthermore, a cathode ray tube is not only expensive, but also produces an insufficient quantity of light. Another prior art apparatus using discharge lamps is relatively inexpensive and provides sufficient luminance, thus achieving high luminous efficacy. However, a current limiting element is required to turn on the discharge lamp, and the following problem thus occurs. When the discharge lamp is turned on with a DC voltage, a resistor must be used as the current limiting element and power consumption is increased due to the use of the resistor. When the discharge lamp is turned on with a commercial AC voltage, an inductor or capacitor can be used as the current limiting element. However, prior art apparatus of this type have poor response characteristics for video signals.

Engineers, including the present inventors, disclosed a large image display apparatus in Japanese Patent Disclosure No. 59-19995 (corresponding to U.S. Pat. No. 4,635,052). According to this apparatus, discharge lamps are used as display elements which are turned on with a high frequency voltage. The apparatus has low power consumption and high response to video signals, and at the same time, is compact and light. However, since the discharge lamps are turned on with an AC voltage, preheating filaments are required for both electrodes so as to instantaneously turn on the discharge lamps. For this reason, power consumption cannot be sufficiently decreased.

SUMMARY OF THE INVENTION

It is, therefore, an object of the present invention to provide a large image display apparatus which is compact and light, which has discharge lamps as display elements turned on with a high frequency voltage, and which can use less power than prior art inventions.

In order to achieve the above object of the present invention, there is provided a large image display apparatus, comprising a plurality of discharge lamps each having an anode, a cathode and a light emitting tube, a display board having the plurality of discharge lamps thereon, a heating circuit for heating the cathodes of the plurality of discharge lamps, a power supply circuit for generating a rectified high frequency voltage and biasing the plurality of discharge lamps, an image signal generator for generating an image signal, and a control circuit for controlling quantity of light emitted from each discharge lamp in response to the image signal.

In order to achieve high-quality image display and a high-packing density in a conventional large image display apparatus, compact display elements (discharge lamps in the present invention) with relatively low power consumption are required. When the discharge lamps are to be immediately turned on, it is always preferable to preheat the filaments so as to be able to immediately turn on the lamps. The ratio of the preheating power of the filaments to the operating power of the discharge lamps is substantially 1:1. However, according to the present invention, DC operating discharge lamps are used, so that only one of the filaments provided with the anode and cathode need be preheated, thereby greatly decreasing power consumption.

According to the present invention, since the discharge lamps are turned on with a high frequency pulsating voltage, inductors can be used as current-limiting elements. As a result, the apparatus of the present invention has low power consumption and high response.

The high frequency is defined herein as a frequency of several hundreds of hertz or more, preferably 20 kHz to 50 kHz. The display apparatus of the present invention can be used for monochrome and full-color image display. The quantity of light emitted from the DC operating discharge lamp can be controlled by changing the ON time of the discharge lamp or changing the high frequency pulsating voltage.

BRIEF DESCRIPTION OF THE DRAWINGS

Other objects and advantages will be apparent from the following description taken in conjunction with the accompanying drawings, in which.

DETAILED DESCRIPTION OF THE PREFERRED EMBODIMENTS

Figure 1:
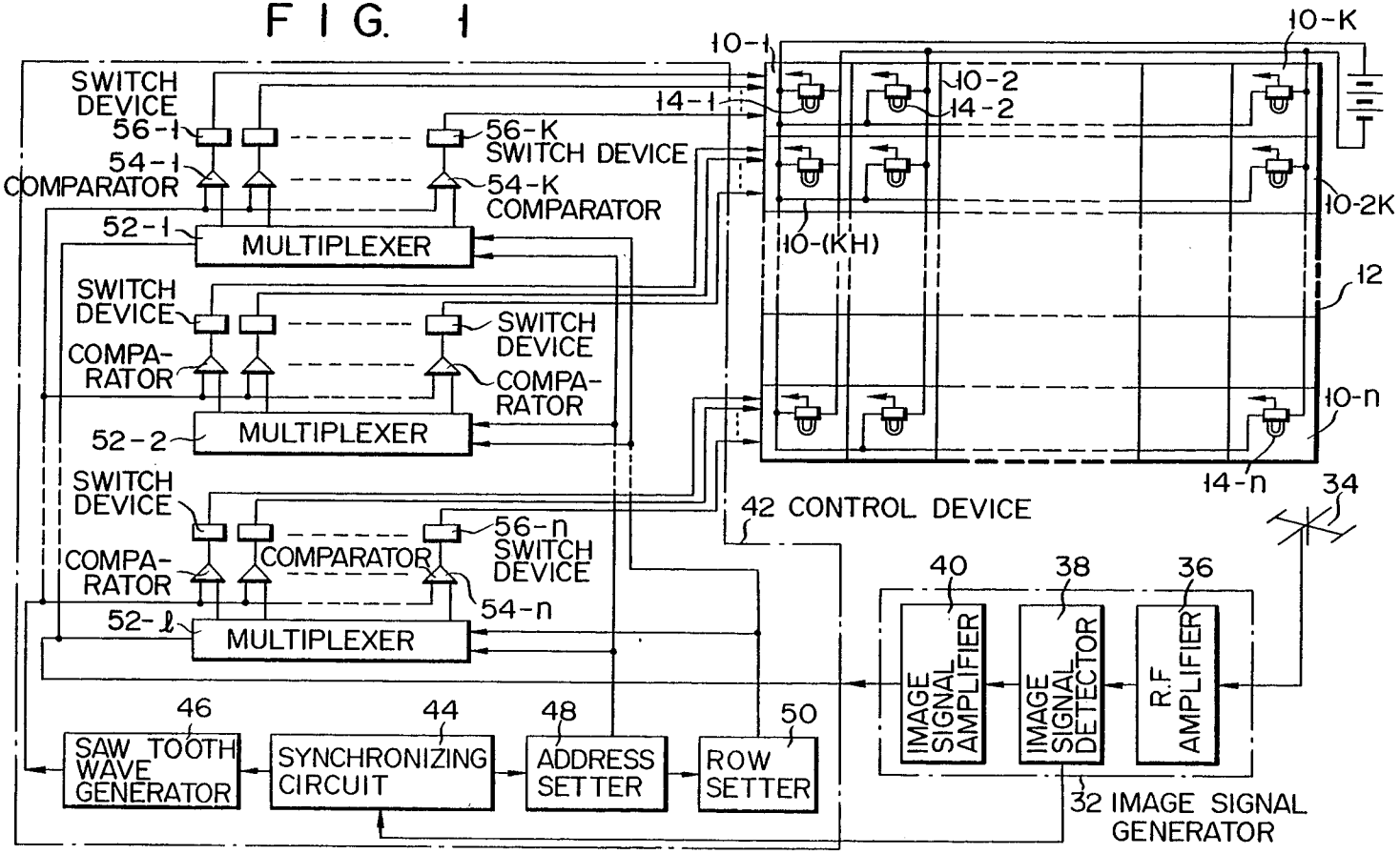
FIG. 1 is a block diagram of a large image display apparatus according to an embodiment of the present invention.
Figure 2:
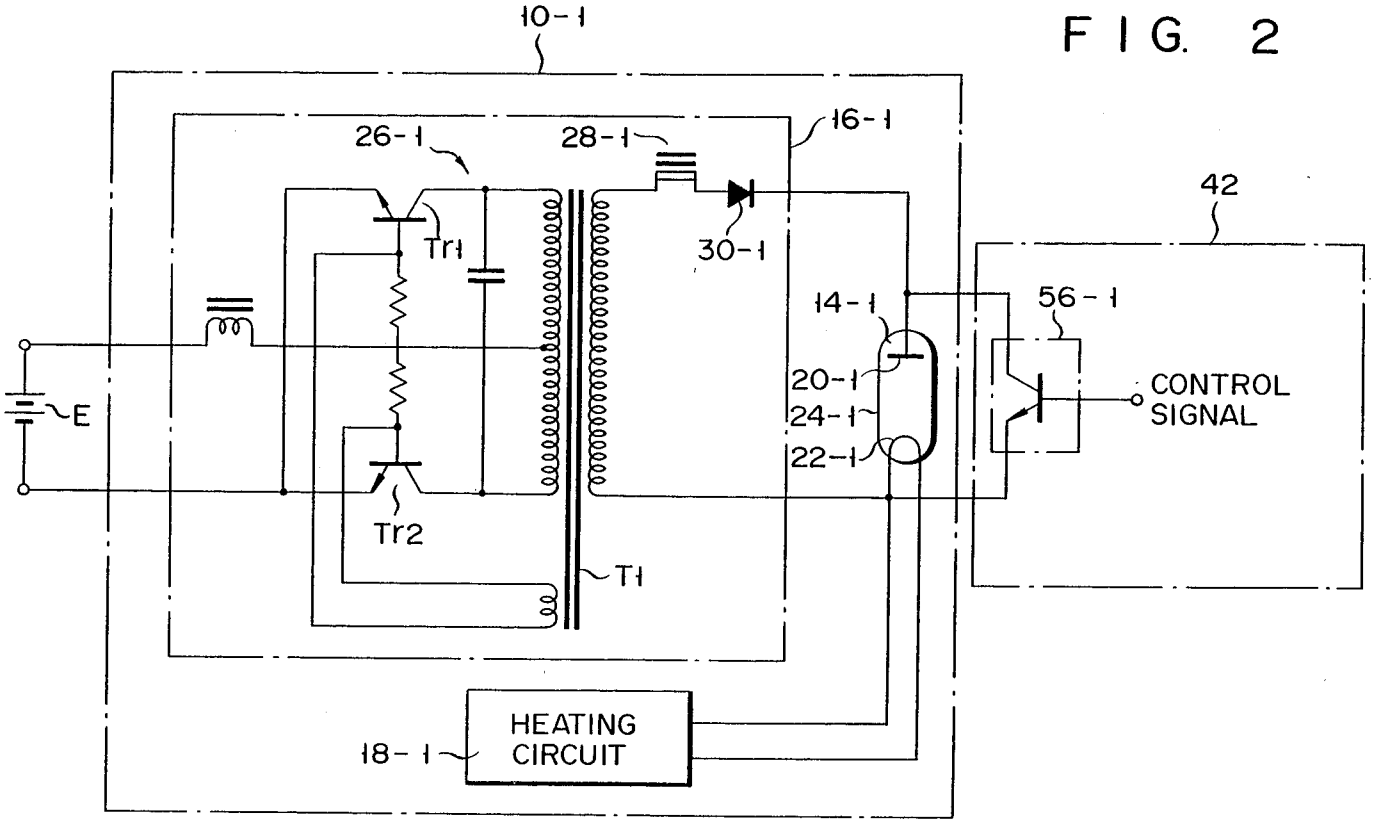
FIG. 2 is a circuit diagram of a display element and a switch element which are used in the display apparatus of FIG. 1.
Figure 3:
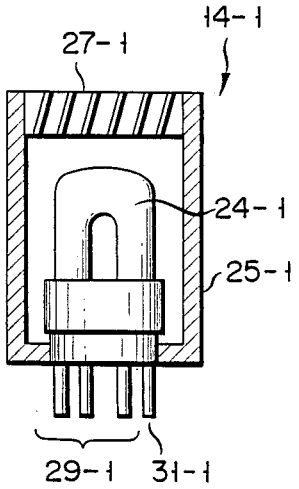
FIG. 3 is a sectional view of a DC operating discharge lamp used as the display element of FIG. 2.

A large image display apparatus according to a first embodiment of the present invention will be described with reference to FIGS. 1 to 4. This embodiment exemplifies the case wherein a monochrome television signal is displayed. As shown in FIG. 1, a large number (e.g., several thousands to several hundred thousands) of display elements 10-1, 10-2, . . . 10-n are arranged on an electroluminescent board 12. The board 12 is installed in, for example, a ball park and is large enough size to provide a clear display to spectators far from the board 12. As shown in FIG. 2, the element 10-1 comprises a DC operating discharge lamp 14-1, e.g., a fluorescent lamp, a high frequency generator 16-1 for biasing the lamp 14-1 and a heating circuit 18-1 for heating the cathode of the lamp 14-1. The lamp 14-1 comprises an anode 20-1, a cathode 22-1 and a light emitting tube 24-1. The cathode 22-1 is constituted by a filament coated with an electron emitting material. A current flows from the heating circuit 18-1 to the filament which then constantly emits electrons to instantaneously light the lamp 14-1. The lamp 14-1 can comrise a straight tube or a U-shaped tube. Preferably, the lamp 14-1 comprises a U-shaped tube, as shown in FIG. 3, which shows the structure of the lamp 14-1. The tube 24-1 is housed in a cylindrical case 25-1. An opening is formed at the top of the case 25-1 to project light emitted from the tube 24-1. A shader 27-1 is fitted in the opening. Pins 29-1 and a pin 31-1 are arranged at the bottom of the case 25-1. The pins 29-1 are connected to the generator 16-1 and the circuit 18-1, and the pin 31-1 is used to apply a voltage to the wall of the tube 24-1.

The high frequency generator 16-1 comprises an inverter 26-1 for converting a DC voltage E to an AC RF voltage, a current limiting element 28-1 for controlling a current flowing through the lamp 14-1 and a rectifier element 30-1, e.g., a diode for rectifying the AC high frequency voltage to a DC high frequency voltage and generating a high frequency pulsating voltage. The inverter 26-1 utilizes resonance of a capacitor and an inductor to alternately turn on/off transistors Tr1 and Tr2 and generates a sinusoidal or rectangular wave high frequency voltage. A 30-kHz high frequency voltage, for example, is generated from the generator 16-1. The element 28-1 comprises, for example, an inductor, but can be replaced with a capacitor or a combination of an inductor and a capacitor. However, the element 28-1 should not only comprise a resistor in consideration of power loss and an increase in heat radiated therefrom.

The heating circuit 18-1 can comprise a state-of-the-art heating circuit. The circuit 18-1 can also be a circuit for generating an AC or DC voltage. The high frequency generator 16-1 can also serve as the circuit 18-1.

Figure 4:
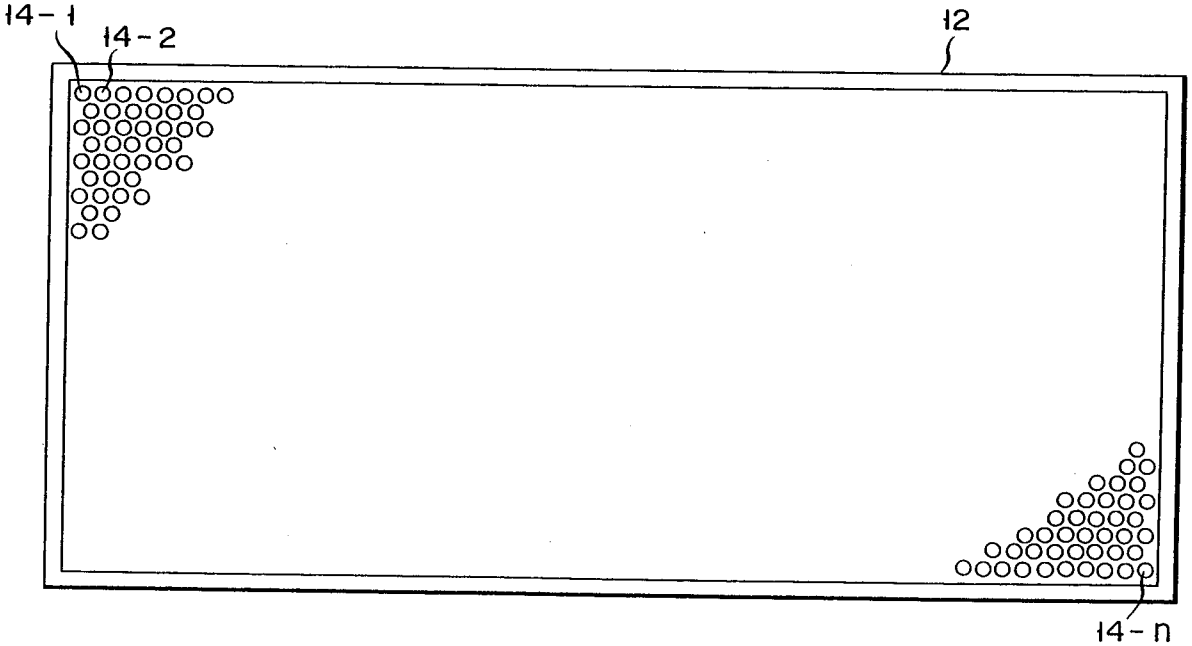
FIG. 4 is a front view of an electroluminescent board used in the display apparatus of FIG. 1.

The arrangement of the display element 10-1 can be applied to that of other display elements 10-2, . . . , 10-n. The display elements 10-1, . . . , 10-n are arranged on the board 12, as shown in FIG. 4, so that the lamps 14-1, 14-2, . . . , 14-n appear at the front surface of the board 12.

Reference numeral 32 in FIG. 1 denotes an image signal generator for generating an image signal to be displayed on the board 12. The generator 32 can display an image of a television signal, a video signal, or a movie signal. The generator 32 generates a television signal in this embodiment. The generator 32 comprises an RF amplifier 36 for amplifying a signal from an antenna 34, an image signal detector 38 and an image signal amplifier 40, and is well known in the art.

Reference numeral 42 denotes a control device for controlling the quantities of light emitted from the elements 10-1, 10-2, . . . 10-n on response to a television signal in units of frames (having 1/60 second period) generated from the generator 32, thereby displaying an image on the board 12. The device 42 controls optical outputs from the elements 10-1 to 10-n in response to the monochrome luminous intensities represented by the image signals. The gradations are 8, 16, and 32 levels, or are represented by continuous gradation.

In this embodiment, the control device 42 comprises a synchronizing circuit 44 for generating a synchronizing signal in accordance with an output of the image signal detector 38 of the image signal generator 32, a saw tooth wave generator 46 controlled by the circuit 44 to generate a saw tooth wave synchronized with the image signal, an address setter 48 controlled by the circuit 44 to set the addresses of the elements 10-1 to 10-k which are aligned in line on the board 12, a row setter 50 for shifting addressing for the next row elements when the address setter 48 completes outputting of address signals for one-row elements 10-1 to 10-k, multiplexers 52-1 to 52-l which constitute l rows in the board 12 to receive the image signal from the generator 32, comparators 54-1 to 54-n arranged in units of k comparators for each multiplexer so as to compare the image signal with the saw tooth wave, and switch devices 56-1 to 56-n for controlling the elements 10-1 to 10-n in response to the outputs from the comparators 54-1 to 54-n, respectively. The arrangement of the control device 42 of this type is well known in the art. The switch devices 56-1 to 56-n comprise bipolar transistors shownn in FIG. 2, respectively. The bases of the transistors receive control signals from the comparators 54-1 to 54-n, and the emitter-collector paths are connected in parallel with the tubes 24-1 to 24-n.

The control device 42 and the image signal generator 32 are housed in the board 12, attached thereto, or mounted in a remote control room (not shown).

Figure 5A:
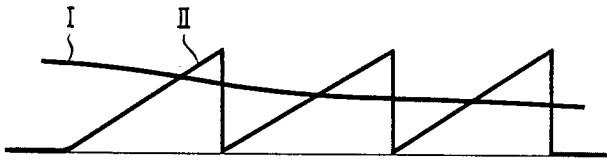
FIGS. 5A to 5C are respectively waveform charts for explaining the operation of the display apparatus of FIG. 1.
Figure 5B:
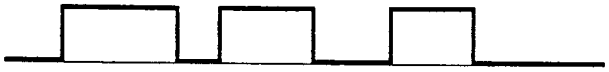
Figure 5C:
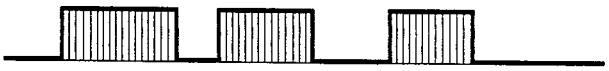

In operation, when the multiplexer 52-1 is controlled by the setters 48 and 50 to generate a signal I shown in FIG. 5A acting as the image signal corresponding to the element 10-1 among the elements 10-1 to 10-k, the comparator 54-1 compares the output I representing this image signal and an output II from the generator 46. The comparator 54-1 generates a signal (FIG. 5B) for determining the ON time of the high frequency voltage applied to the element 10-1. The switch device 56-1 controls the supply of the rectified high frequency voltage applied to the lamp 14-1, as shown in FIG. 4C, in response to the signal from the comparator 54-1. The magnitude of the output In in FIG. 5A represents the luminous intensity of the image signal. When the output I is increased, the high frequency voltage ON time of the lamp 14-1 is increased to emit whitish light. On the other hand, when the output I is small, the optical output is decreased to emit dimmed light. Since the period of the saw tooth wave output II is synchronized by the circuit 44 with the television signal, the light from the lamp 14-1 is changed in accordance with the period of the image signal. The lamps 14-2 to 14-k are controlled in the same manner as described above. When the first row elements in the board 12 are driven, the second-row multiplexer 52-2 is addressed by the row setter 50 to control the elements 10-(k+1) to **10-2*k* in the same manner as described above. When the lth multiplexer addresses the corresponding elements, the next cycle is initiated to display the television image on the board 12**.

In the above embodiment, an output frequency of the generator 16-1 to 16-n is set to be 30 kHz, so that the luminous efficacy of the lamps 14-1 to 14-n is increased.

Although the lamps 14-1 to 14-n are repeatedly turned on/off in response to the image signals such as television signals, lamp life will not be shortened and the high-speed on/off operation can be performed since the filaments of the lamps 14-1 to 14-n are preheated. In other words, filament damage caused by a so-called cold start can be prevented. In addition, since the DC operating discharge lamps 14-1 to 14-n are used, only one of the filaments of each lamp need be preheated, thereby decreasing power consumption by one half and hence decreasing the capacity of the heating circuits 18-1 to 18-n.

Figure 6:
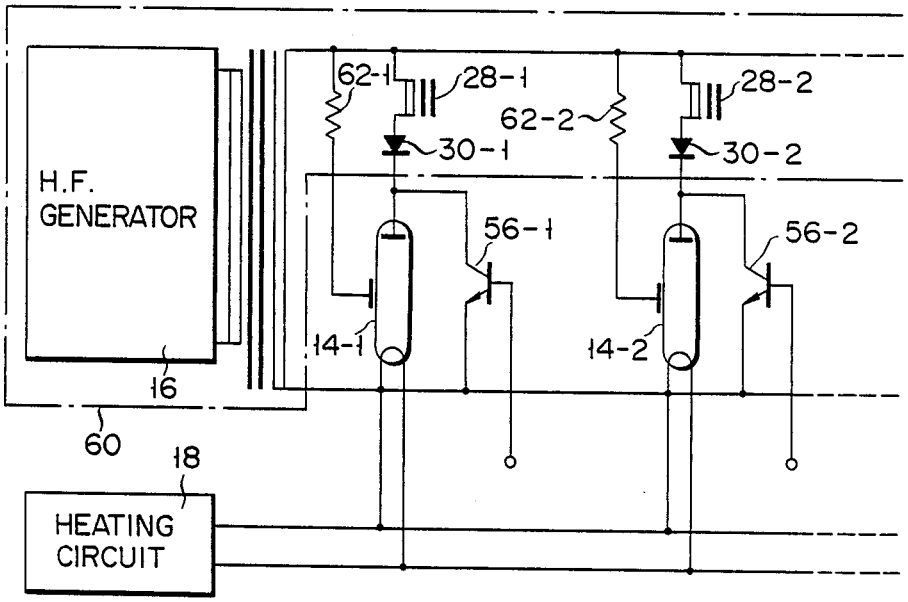
FIGS. 6, 7, 8 are circuit diagrams of display elements used in large image display apparatuses according to other embodiments of the present invention, respectively.

A large image display apparatus according to a second embodiment of the present invention will be described with reference to FIG. 6. A power supply circuit 60 has a high frequency generator commonly used with a plurality of DC operating discharge lamps 14-1 to 14-2, . . . , and current limiting inductors 28-1, 28-2, . . . and rectifier elements 30-1, 30-2, . . . arranged respectively with the lamps 14-1, 14-2, . . . According to the second embodiment, each of the impedance elements 62-1, 62-2, . . . is connected between one of the output terminals of the generator 16 and a corresponding wall surface of the lamps 14-1, 14-2, . . . , thereby applying a voltage between the wall surface and the cathode. For this reason, the filling gas in the lamps 14-1, 14-2, . . . is ionized even if the lamps are kept off, so that the start compression for the next ignition is performed. A filament heating circuit 18 is commonly used in the lamps 14-1, 14-2, . . .

Since the generator 16 and the filament heating circuit 18 are commonly used for the lamps 14-1, 14-2, . . . , the large image display apparatus is compact and light. It should be noted that one end of each of a plurality of switch devices 56-1, 56-2, . . . corresponding to the lamps 14-1, 14-2, . . . is connected to a common potential line, thereby decreasing the number of wires connected to the switch devices 56-1, 56-2, . . . and at the same time eliminating the need for a special insulating means. In the second embodiment, since start compensation is performed, an ignition voltage at the lamps 14-1, 14-2, . . . can be decreased. As a result, filament damage caused by sputtering can be prevented.

Figure 7:
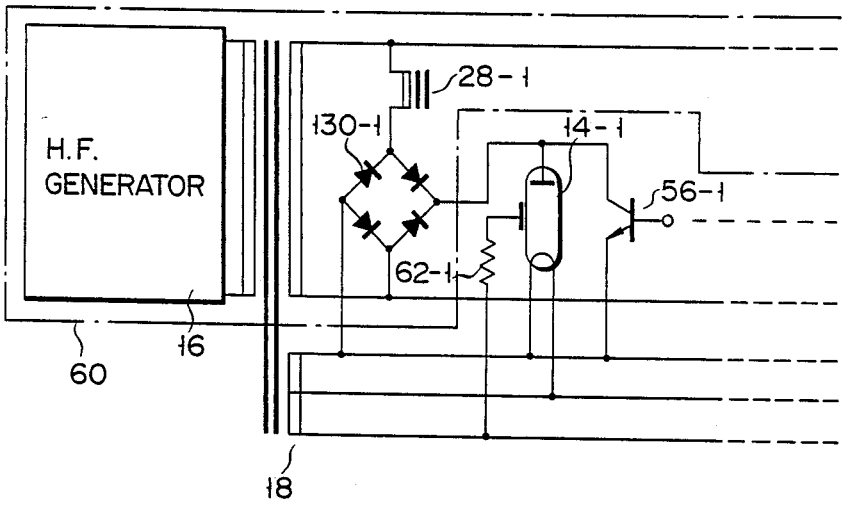

A large image display apparatus according to a third embodiment of the present invention will be described with reference to FIG. 7. According to this embodiment, a rectifier circuit comprises full-wave bridge rectifier circuits 130-1, 130-2, . . . consisting of diodes. Deviations in magnetization of an output transformer in the high frequency generator and the inductors 28-1, . . . can be prevented. As a result, the output transformer and the inductors 28-1, . . . can be made compact. The wall surface of the lamp 14-1 receives a voltage through an impedance element 62-1 connected to one output terminal of the circuit 18.

Figure 8:
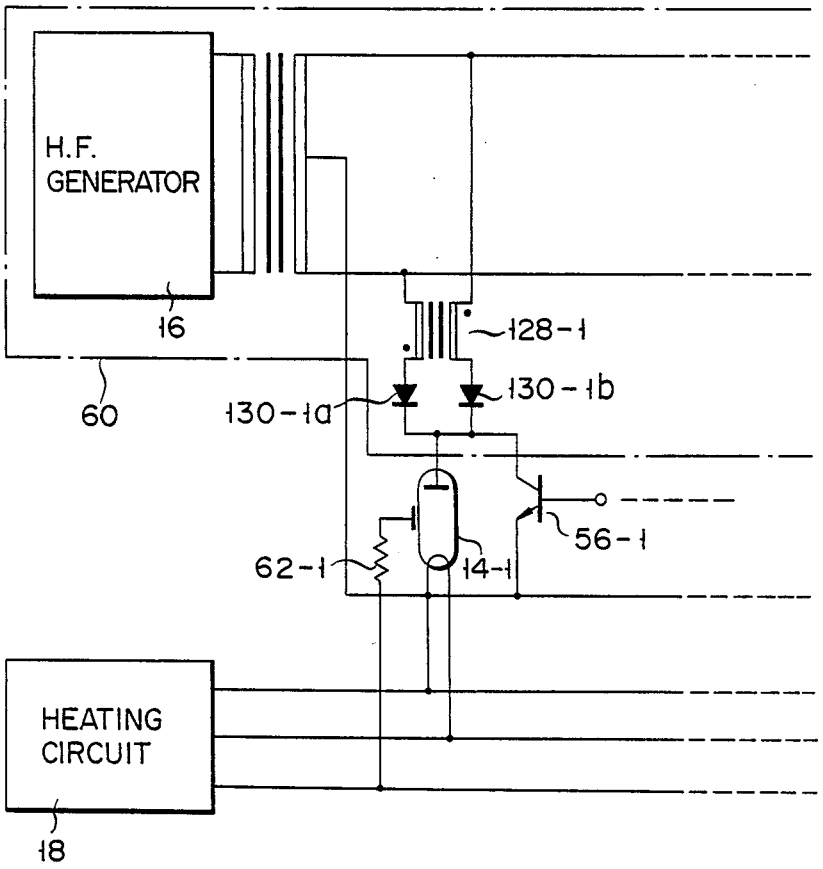

A fourth embodiment in FIG. 8 is exemplified to prevent deviations in magnetization described above. Each of the curent limiting inductors 128-1, . . . comprises a pair of windings wound in the same relationship as the polarities illustrated in FIG. 8. One end of each of the windings is connected to a corresponding output terminal of the generator 16. The other end of each of the windings is connected to the anode of each of the discharge lamps 14-1, . . . through a corresponding rectifier element 130-1*a*, 130-1*b*, . . . The cathode of the lamp 14-1 is connected to the center tap of the output transformer of the generator 16. According to this embodiment, the deviations in magnetization of the output transformer and the current limiting inductors 128-1, . . . can be prevented to obtain compact output transformer and current limiting inductors. Other arrangements of the fourth embodiment are substantially the same as those of the third embodiment of FIG. 7. The same reference numerals in the fourth embodiment denote the same parts as in the third embodiment, and a detailed description thereof will be omitted.

Figure 9:
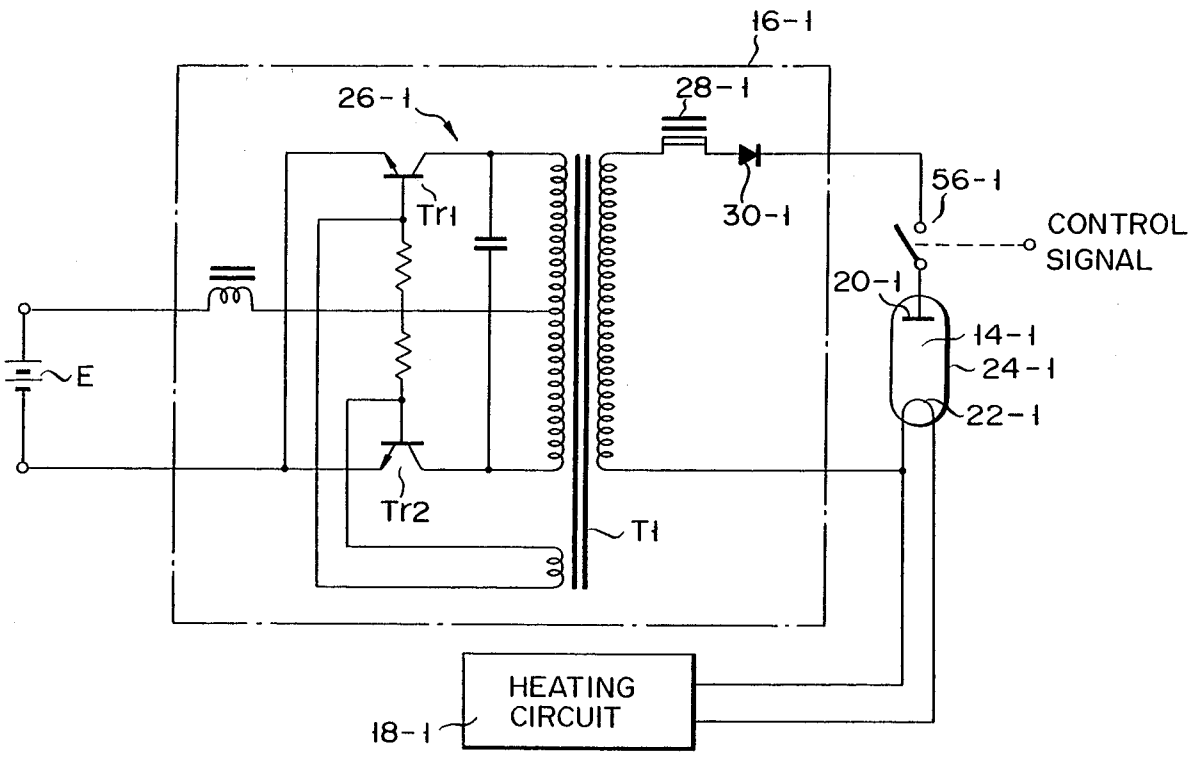
FIG. 9 is a circuit diagram of a display element and a switch element which are used in a large image display apparatus according to still another embodiment of the present invention.

The present invention is not limited to the particular embodiments described above. For example, the switch devices in the control device need not be connected in parallel with the discharge lamps, but can be connected in series therewith, as shown in FIG. 9. However, since the voltage is high frequency voltage, the parallel arrangement is preferred in consideration of the interference caused by a stray capacitance between every adjacent discharge lamp. The current limiting inductor can adapt any arrangement described above. However, it should not comprise only a resistor in consideration of power consumption and heat radiation.

The present invention can also be applied to a color display device. In this case, a plurality of red, green and blue discharge lamps are located adjacent to each other to constitute one picture element.

As is apparent from the above description, the DC operating discharge lamps are biased by the high frequency pulsating voltage, so that the filament heating power can be decreased while an advantage inherent to high frequency lighting can be maintained, thereby greatly saving power in a large image display apparatus having a large number of discharge lamps.

What is claimed is:

1. A large image display apparatus comprising:

a plurality of DC operating discharge lamps each having an anode, a cathode and a light emitting tube;

a display board having the plurality of discharge lamps;

high frequency generating means having first and second terminals and for generating a high frequency voltage between said first and second terminals;

a plurality of rectifying means, each connected between said anode of said respective discharge lamps and said first terminal of said high frequency generating means, for generating a DC voltage including a high frequency ripple voltage component between said first and second terminals, a voltage of said first terminal being higher than that of said second terminal;

a plurality of current limiting means, each series connected with said respective rectifying means, for limiting a current flowing through said respective discharge lamps;

means for commonly connecting said second terminal with said cathodes of the plurality of discharge lamps;

heating means for commonly heating the cathodes of the plurality of discharge lamps;

image signal generating means for generating an image signal; and a plurality of switching means comprises a bipolar transistor having a base receiving a control signal dependent on the image signal and an emitter-collector path connected in parallel with said discharge lamp, arranged in parallel between the anode and cathode of said respective discharge lamps, for turning on/off the respective discharge lamps in response to the image signal, terminals of said plurality of switching means which are connected to the respective cathodes being commonly connected to said second terminal of said high frequency generating means.

2. The apparatus according to claim 1, wherein each of said discharge lamps comprise a fluorescent lamp.

3. The apparatus according to claim 2, wherein said fluorescent lamp comprises a U-shaped light emitting tube.

4. The apparatus according to claim 1, wherein three discharge lamps respectively emitting red, green and blue color light are disposed closely adjacent to form one picture element.

5. The apparatus according to claim 1, wherein said high frequency generating means is commonly provided for the plurality of DC operating discharge lamps.

6. The apparatus according to claim 1, wherein said high frequency generating means is an inverter.

7. The apparatus according to claim 6, wherein said inverter generates a high frequency voltage having a frequency of 20 kHz to 50 kHz.

8. The apparatus according to claim 1, wherein said rectifying means includes a diode circuit.

9. The apparatus according to claim 1, wherein said current limiting means is an inductor.

10. The apparatus according to claim 1, wherein said control means includes means for varying an interval in which an output of said power supply means is supplied to said discharge lamp for each image of the video signal generated by said image signal generating means.

11. The apparatus according to claim 1, further comprising potential supply means for supplying a potential between a wall surface and said cathode of said discharge lamp.

12. The apparatus according to claim 11, wherein said potential supply means comprises an impedance element connected between one output terminal of said power supply means and said wall surface of said discharge lamp.

13. The apparatus according to claim 11, wherein said potential supply means comprises an impedance element connected between one output terminal of said heating means and said wall surface of said discharge lamp.

* * * * *